US006527313B2

(12) United States Patent
Takahashi et al.

(10) Patent No.: US 6,527,313 B2
(45) Date of Patent: Mar. 4, 2003

(54) LATCH DEVICE FOR TRUNK LID OF VEHICLE TRUNK ROOM

(75) Inventors: Akira Takahashi, Yamanashi-ken (JP); Hirofumi Watanabe, Yamanashi-ken (JP); Miki Ogino, Yamanashi-ken (JP)

(73) Assignee: Mitsui Kinzoku Kogyo Kabushiki Kaisha, Tokyo (JP)

( * ) Notice: Subject to any disclaimer, the term of this patent is extended or adjusted under 35 U.S.C. 154(b) by 68 days.

(21) Appl. No.: 09/749,441

(22) Filed: Dec. 28, 2000

(65) Prior Publication Data

US 2001/0005081 A1 Jun. 28, 2001

(30) Foreign Application Priority Data

Dec. 28, 1999 (JP) ..... 11-373263

(51) Int. Cl.[7] ..... E05B 3/00

(52) U.S. Cl. ..... 292/336.3; 292/DIG. 43; 296/76

(58) Field of Search ..... 292/347, 336.3, 292/DIG. 43, DIG. 65; 296/76

(56) References Cited

U.S. PATENT DOCUMENTS

| | | | | |
|---|---|---|---|---|
| 3,016,968 A | * | 1/1962 | Lenz | 180/82 |
| 4,155,233 A | | 5/1979 | Lira | |
| 4,998,758 A | * | 3/1991 | Kowalczyk | 292/201 |
| 5,445,326 A | | 8/1995 | Ferro | |
| 6,018,292 A | | 1/2000 | Penny, Jr. | |
| 6,086,131 A | * | 7/2000 | Bingle | 296/76 |
| 6,209,933 B1 | * | 4/2001 | Ang | 292/336.3 |
| 6,349,984 B1 | * | 2/2002 | Marrazzo | 292/336.3 |

FOREIGN PATENT DOCUMENTS

| | | |
|---|---|---|
| GB | 2 276 416 A | 9/1994 |
| GB | 2 278 876 A | 12/1994 |
| GB | 2 283 782 A | 5/1995 |

* cited by examiner

*Primary Examiner*—Gary Estremsky
(74) *Attorney, Agent, or Firm*—Browdy and Neimark

(57) ABSTRACT

A trunk lid latch device comprises a latch unit and a striker. The latch unit has a latch engageable with the striker, a ratchet for keeping engagement between the latch and the striker, and an open lever for releasing the ratchet from the latch. An emergency knob formed of a luminous material is coupled to the open lever and accessible from inside the trunk room. The emergency knob is disposed inside a frame member of a trunk lid or a vehicle body so as not to protrude into the trunk room. The emergency knob comprises a printed symbol that suggests an opening of the trunk lid.

5 Claims, 7 Drawing Sheets

LATCH DEVICE FOR TRUNK LID OF VEHICLE TRUNK ROOM

TECHNICAL FIELD

The present invention relates to a latch device for a trunk lid of a vehicle trunk room.

BACKGROUND OF THE INVENTION

A conventional latch device for a trunk kid of a trunk room comprises a latch unit mounted on one of a trunk lid and a trunk room (vehicle body), and a striker mounted on the other of the trunk lid and the trunk room. The latch unit includes a latch engageable with the striker, a ratchet for keeping the engagement between the latch and the striker by engaging with the ratchet, and an open lever for releasing the ratchet from the latch.

The open lever is coupled to a motorized actuator, a key cylinder and/or an operation handle in the passenger room of the vehicle. When one of them is actuated, the open lever releases the ratchet from the latch so as to open the trunk lid.

A typical trunk room is separated from the passenger room by a partitioning wall, which substantially prevents a person from moving from one of the rooms to the other. Thus, the switch for activating the actuator, the key cylinder and operation handle are practically inaccessible from inside the trunk room.

SUMMARY OF THE INVENTION

An object of the present invention is therefore to provide a latch device for a trunk lid provided with an emergency knob accessible from inside the trunk room.

DESCRIPTION OF THE PREFERRED EMBODIMENTS

Figure 1:
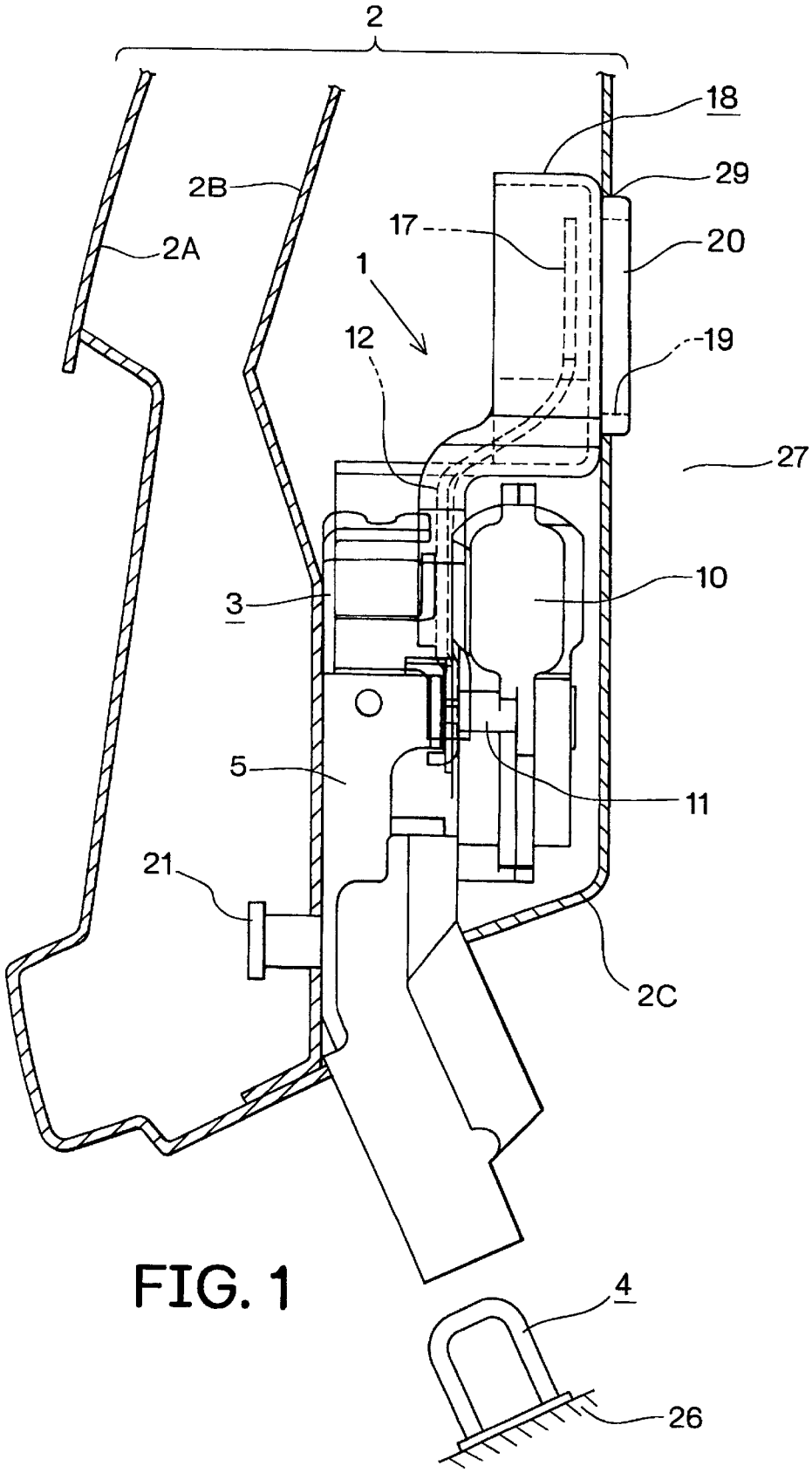
FIG. 1 is a vertical sectional view of the latch device and a frame member of a trunk lid according to the present invention.
Figure 2:
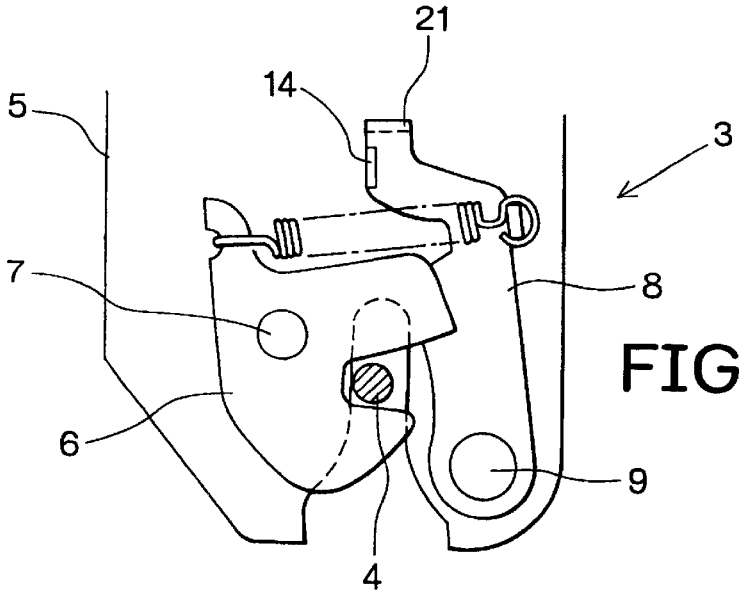
FIG. 2 is a partial view showing a latch and a ratchet of the latch device.

Referring to FIGS. 1 to 4, a latch device 1 for a trunk lid of the first embodiment according to the present invention comprises a latch unit 3 and a striker 4. The latch unit 3 is mounted on a frame member 2 of one of a vehicle body and a trunk lid hingedly mounted on the vehicle body. The striker 4 is fixedly mounted to a frame member 26 of the other of the vehicle body and the trunk lid. The frame member 2 shown in FIG. 1 is a frame member of the trunk lid, and comprises an outer metallic panel 2A facing outside, a lining panel 2C facing a trunk room 27, and an inner metallic panel

2B disposed between the panels 2A and 2C. The frame member of the vehicle body has a similar structure to the frame member 2. The latch unit 3 includes a vertically elongated metallic base plate 5. At a lower portion of the base plate 5, the latch 6 engaged with the striker 4 is supported by the latch shaft 7, and a ratchet 8 for holding the engagement between the latch 6 and the striker 4 by engaging with the latch 6, is supported by a ratchet shaft 9.

A motorized actuator 10 is mounted at an intermediate portion of the base plate 5. An open lever 12 is secured to an output shaft 11 of the actuator 10. The open lever 12 comprises three arms, that is, a downwardly extending ratchet arm 13, a laterally extending coupling arm 15, and an upwardly extending operation arm 16. The ratchet arm 13 is engageably opposed to a protrusion 14 formed on the ratchet 8. When rotating the open lever 12, the ratchet 8 is released from the latch 6 by contact with the arm 13 of the open lever 12, and the trunk lid is then opened. The coupling arm 15 is coupled to a cabin handle 28 provided in the passenger room of the vehicle through a wire cable or rod.

The ratchet 8 has a protrusion 21 which is coupled to a key cylinder (not shown) of the trunk lid. The actuator 10 may be omitted.

The operation arm 16 of the open lever 12 carries an emergency knob 17 at its tip end. The emergency knob 17 is made of a luminous material. Printed on the outer surface of the knob 17 are some symbols 30 that clearly indicate that the trunk lid can be opened. A typical symbol 30 comprises a letter "OPEN", an arrow indicating the rotating direction, and/or an illustration representing the trunk lid in the open state. When the trunk room 27 gets dark due to the closure of the trunk lid, the luminous material will allow the symbol 30 to stand out in the darkness. Thus, anyone who might have been locked up in the trunk room 27 in error can easily find the symbol 30 and thus the emergency knob 17.

The base plate 5 carries at its top a resin case 18. The case 18 comprises a window 19 communicating with the trunk room 27 and a flange 20 formed at the outer circumference of the window 19. The flange 20 protrudes from inside of the frame member 2 through an opening 29 formed in the lining panel 2C toward the trunk room 27. The emergency knob 17 is located in a position superposing with the window 19 and thus is capable of being operated from inside the trunk room 27. Since the case 18 is provided within the frame member 2 except the flange 20, so that the emergency knob 17 does not protrude into the trunk room 27.

Figure 4:
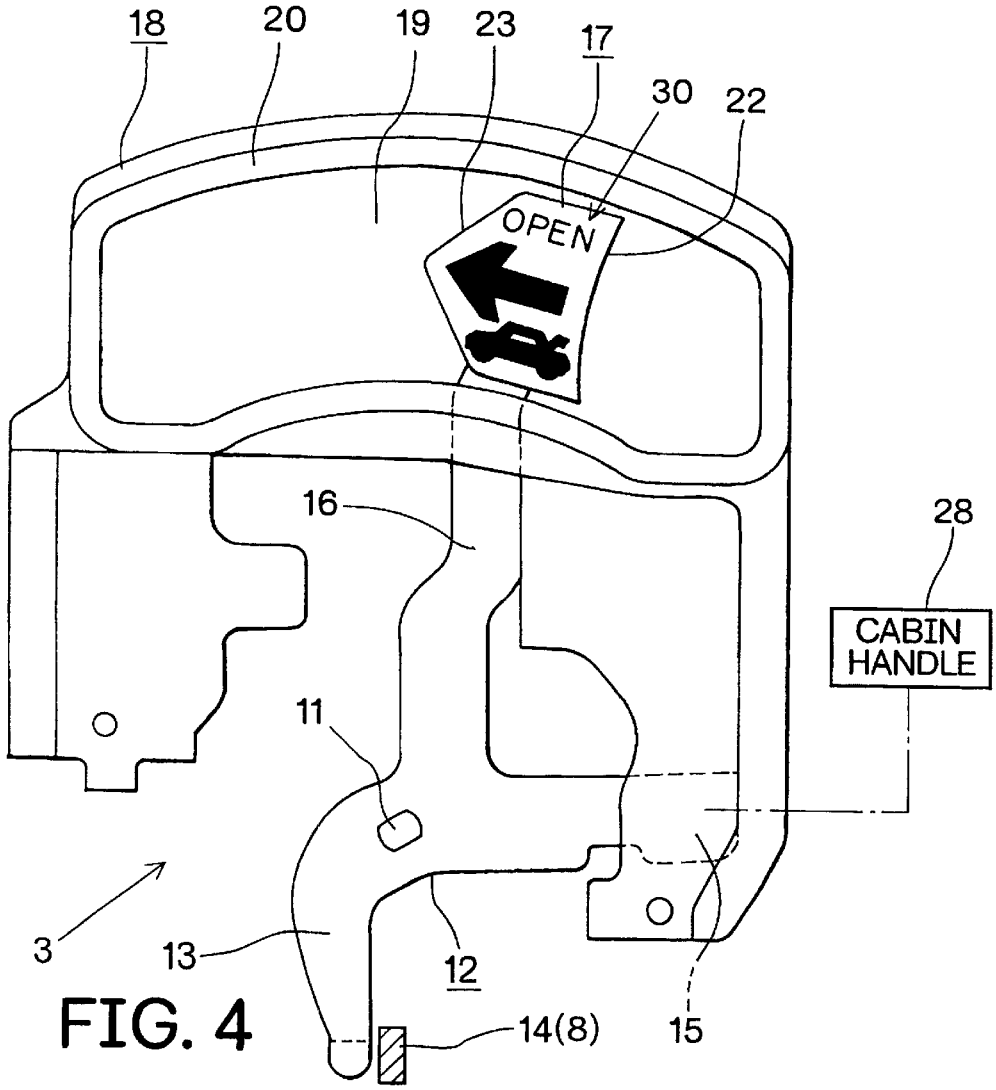
FIG. 4 is a plan view showing a case and an emergency knob of the latch unit of the first embodiment.
Figure 3:
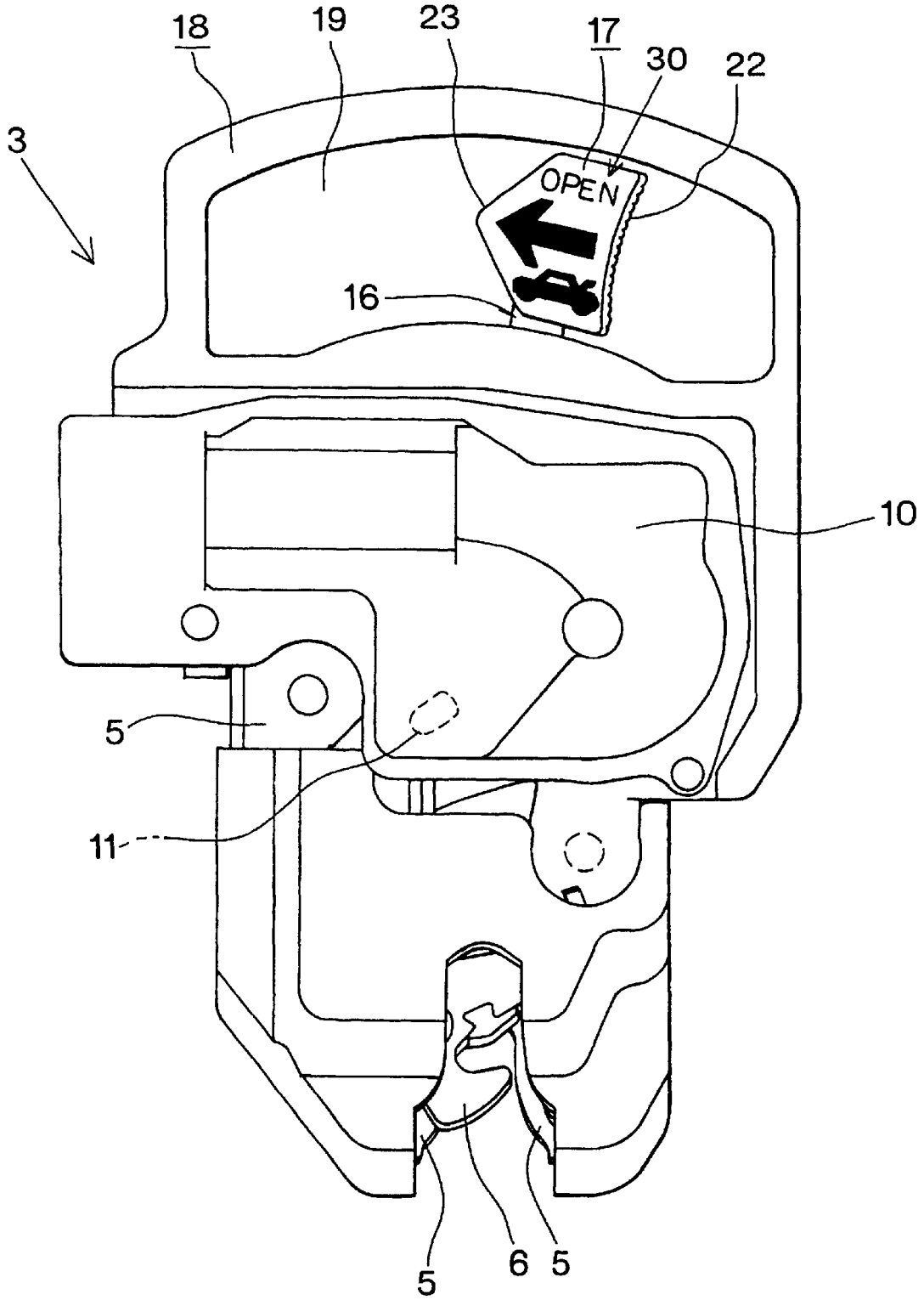
FIG. 3 is a plan view of a latch unit of a first embodiment.

In the first embodiment of the invention shown in FIGS. 3 and 4, the emergency knob 17 has a right side surface or pushing surface 22 and a left side surface or pulling surface 23, which are both exposed from inside the trunk room through the window 19.

The operation of the first embodiment is now described. When the trunk lid is moved to the opening direction, the latch 6 is rotated due to the engagement with the striker 4, and the ratchet 8 is then engaged with the latch 6 so as to keep the closed state of the trunk lid.

In order to open the trunk lid by an ordinary means, the open lever 12 is rotated counterclockwise by the actuator 10 or the cabin handle 28. The rotation of the open lever 12 is transmitted through the protrusion 14 to the ratchet 8, thus releasing the ratchet 8 from the latch 6 thereby the trunk lid is opened. As for the rotation of the key cylinder too, it is possible to open the trunk lid by rotating the ratchet 8 through the protrusion 21.

When a person is locked up in the trunk room 27 in error, it is difficult or utterly impossible to open the trunk lid by the ordinary means. But in such a case, by pushing the pushing surface 22 of the emergency knob 17 in the opening direction to rotate the open lever 12 counterclockwise, the trunk lid can be opened. Although the trunk room 27 is ordinarily pitch-dark, the person locked in the trunk room can find the emergency knob 17 very easily because the knob 17 is made of a luminous material. Furthermore, since the symbol 30 is printed on the emergency knob 17, which suggests the opening of the trunk lid, even a child can operate the emergency knob 17 without falling into a panic.

The emergency knob 17, which is located in the case 18, does not protrude into the trunk room 27. If the knob 17 protrudes into the trunk room 27, it could make it difficult to open the trunk lid by the above-described ordinary means. That is, when a plurality of objects in the trunk room 27 move due to external forces caused by vibration, acceleration and deceleration during the vehicle is traveling, the protruding emergency knob 17 might get stuck by getting caught by one of such objects. If the knob 17 gets stuck, the rotation of the open lever 12 is impossible. To avoid such an event, the emergency knob 17 is arranged in the case 18 so as not to protrude therefrom.

Figure 5:
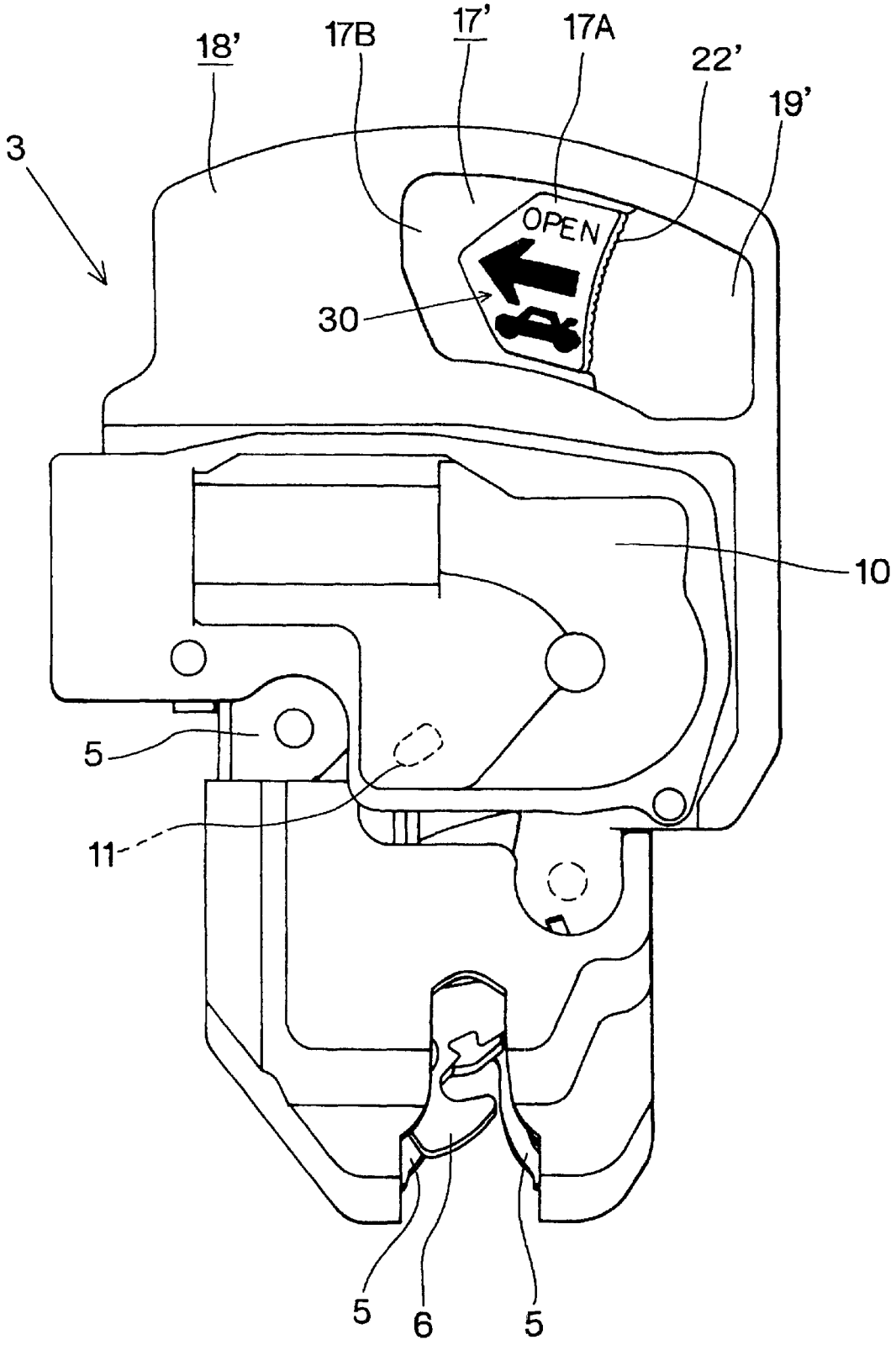
FIG. 5 is a plan view of a latch unit of a second embodiment.
Figure 6:
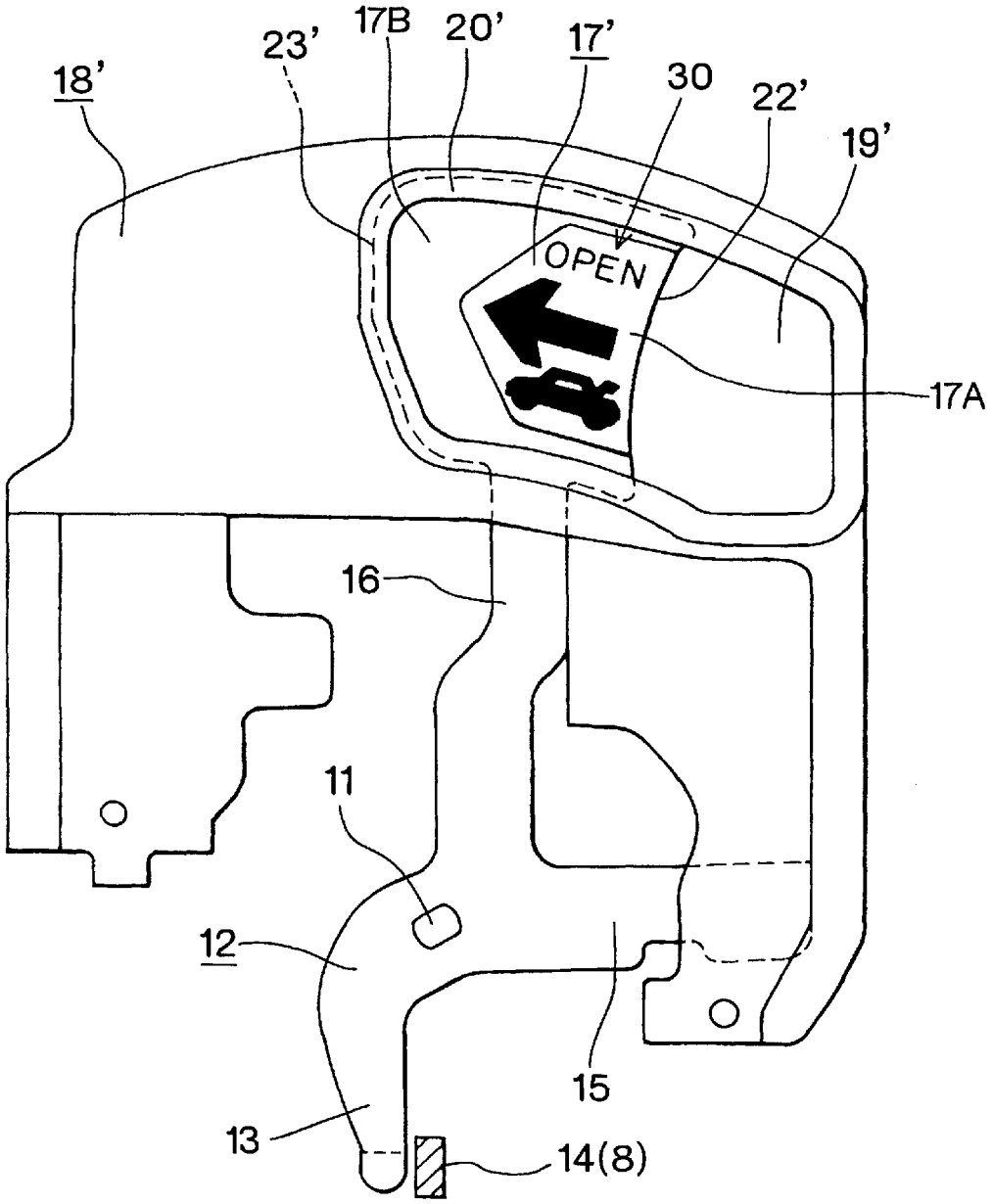
FIG. 6 is a plan view showing a case and an emergency knob of the latch unit of the second embodiment.
Figure 7:
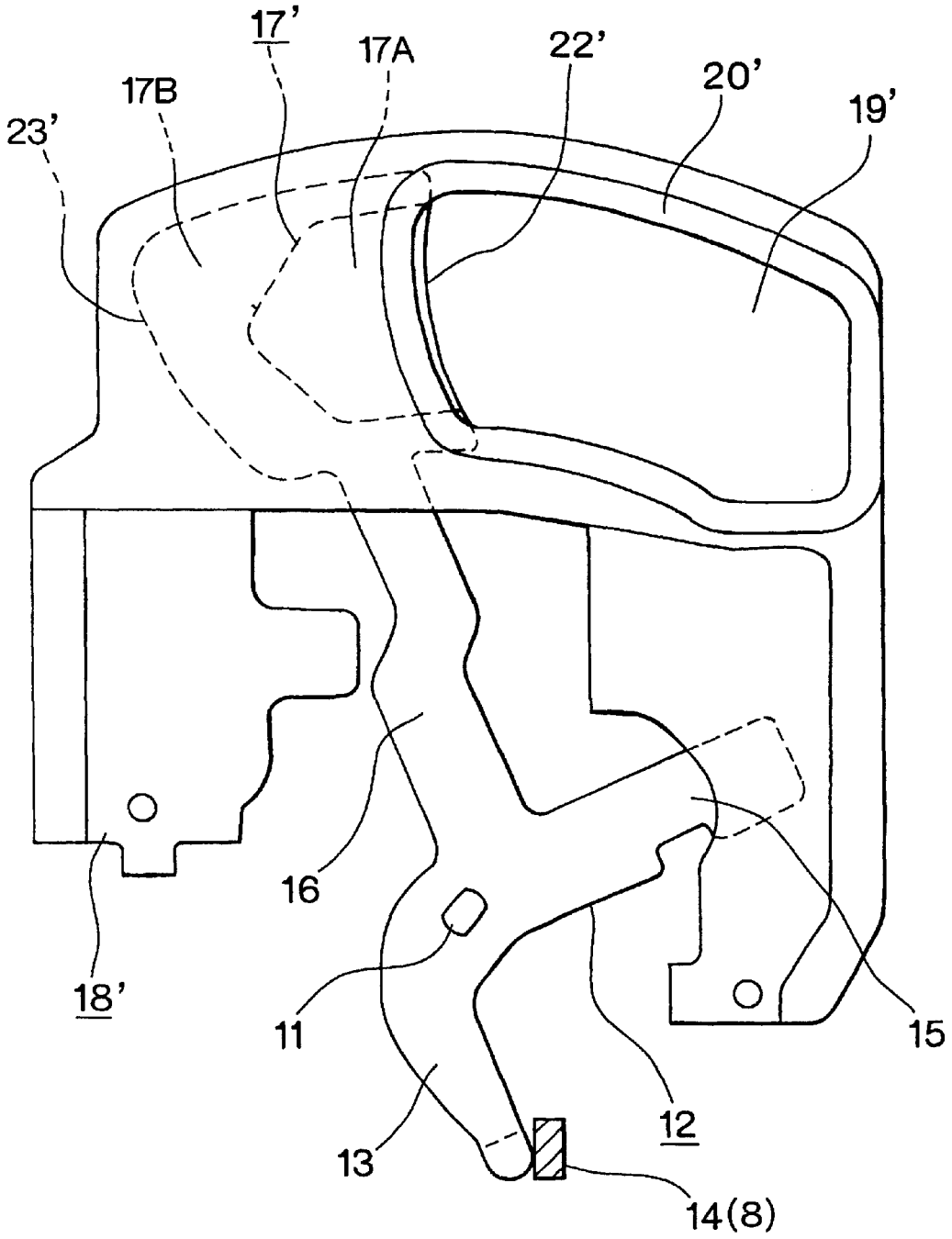
FIG. 7 is a plan view of the emergency knob of FIG. 6 when it is rotated.

The second embodiment is now described with reference to FIGS. 5 to 7. In the second embodiment, the shapes of a case 18' and an emergency knob 17' are modified. The case 18' has a window 19' that is smaller than the window 19 of the first embodiment, while an emergency knob 17' is larger than the emergency knob 17 of the first embodiment. The larger emergency knob 17' comprises a luminous portion 17A formed of a luminous material and identical in shape to the emergency knob 17, and a panel portion 17B on which the luminous portion 17A is mounted. While a pushing surface 22' of the emergency knob 17' is seen through the window 19', its pulling surface 23' is not seen therethrough.

The panel portion 17B of the second embodiment covers the left side portion of the window 19' of the case 18' so that the object disposed in the trunk room 27 cannot enter the left side portion of the window 19', thereby the object is prevented from blocking the counterclockwise rotation of the emergency knob 17'.

Figure 8:
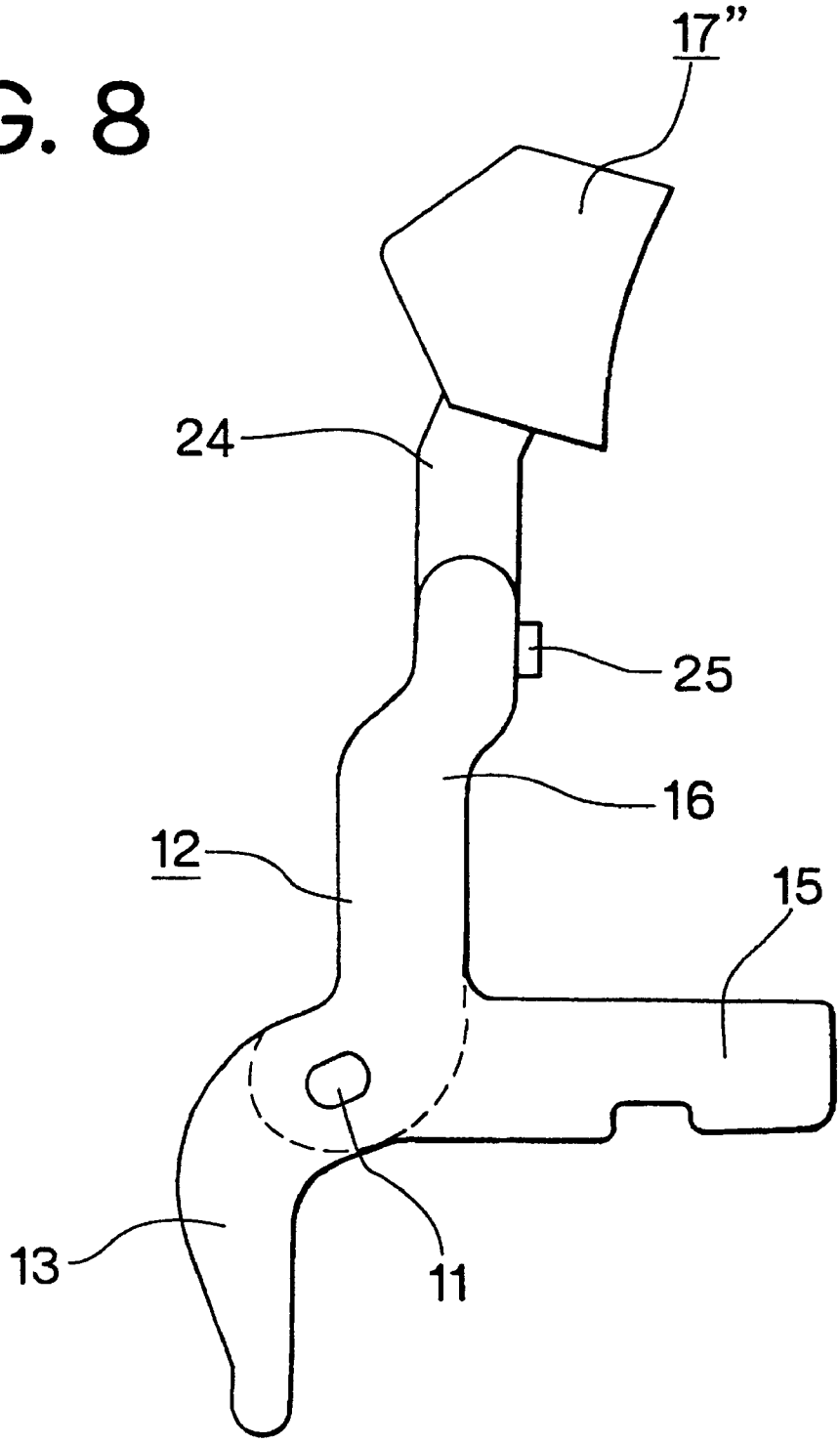
FIG. 8 is a plan view showing an emergency knob and a sub lever of a third embodiment.

FIG. 8 shows the third embodiment, in which an emergency knob 17" is mounted on a sub lever 24 instead of the arm 16 of the open lever 12. The sub lever 24 is rotatably mounted on the shaft 11 and has a bent piece 25 engageable with the operation arm 16 of the open lever 12. When the sub lever 24 is rotated counterclockwise by means of the emergency knob 17", the bent piece 25 pushes the arm 16 to rotate the open lever 12 counterclockwise.

In the third embodiment, the open lever 12 can rotate independently of the emergency knob 17". Thus, even if an object in the trunk room 27 restricts the rotation of the emergency knob 17", it is possible to open the trunk lid by the ordinary means, i.e. the cabin handle 28 or actuator 10.

What is claimed is:

1. A trunk lid latch device for a vehicle trunk room comprising: a latch unit provided in a first frame member of one of a vehicle body and a trunk lid hingedly mounted to the vehicle body;

the first frame member having an outer panel facing outward, a lining panel facing inward toward the truck room and an inner panel disposed between the outer and lining panels; a striker fixedly mounted on a second frame member of the other of the vehicle body and the trunk lid;

said latch unit located on a base plate engaged to the inner panel and comprising a latch engageable with the striker, a ratchet for keeping engagement between the latch and the striker by being engaged with the latch, and an open lever for releasing the ratchet from the latch;

an emergency knob located in a case engaged between the base plate and the lining panel and formed of a luminous material, said emergency knob being coupled to the open lever;

wherein the case is located behind an opening in the lining panel so that the emergency knob and the case surrounding the emergency knob do not protrude into the trunk room; and wherein the emergency knob is accessible through the opening by a person in the trunk room when closed.

2. The latch device according to claim 1, wherein said emergency knob has a printed symbol that suggests an opening of the trunk lid.

3. The latch device according to claim 2, wherein said symbol includes an arrow that indicates an operating direction of the emergency knob.

4. The latch device according to claim 1, wherein said emergency knob has a pushing surface and a pulling surface disposed on an opposite side of the pushing surface, said pulling surface being located behind a wall on the case and therefore not visible from the trunk room.

5. The latch device according to claim 1, wherein the emergency knob is so coupled to the open lever through a sub lever that a rotation of the sub lever is transmitted to the open lever but rotation of the open lever is not transmitted to the sub lever.

* * * * *